US010364565B1

(12) United States Patent
Jackson

(10) Patent No.: US 10,364,565 B1
(45) Date of Patent: Jul. 30, 2019

(54) SUB-FLOOR BRACE FOR ABATING SQUEAKING FLOORS

(71) Applicant: Jimmy Jackson, Tuscaloosa, AL (US)

(72) Inventor: Jimmy Jackson, Tuscaloosa, AL (US)

( * ) Notice: Subject to any disclaimer, the term of this patent is extended or adjusted under 35 U.S.C. 154(b) by 136 days.

(21) Appl. No.: 15/602,694

(22) Filed: May 23, 2017

(51) Int. Cl.
*E04C 3/02* (2006.01)
*E04B 1/24* (2006.01)
*E04B 5/10* (2006.01)

(52) U.S. Cl.
CPC ..... *E04B 1/2403* (2013.01); *E04B 5/10* (2013.01); *E04B 2001/2421* (2013.01); *E04B 2001/2439* (2013.01)

(58) Field of Classification Search
CPC ..... E04C 2003/026; E04C 3/02; E04C 3/005; E04C 2003/0465; E04G 25/04
See application file for complete search history.

(56) References Cited

U.S. PATENT DOCUMENTS 933,650 A * 8/1909 Kramer ..... B25H 1/06 182/155
1,496,133 A 6/1924 Rothrock
2,442,726 A 6/1948 Gastalder
2,455,904 A 12/1948 Meulenbergh
3,648,425 A 3/1972 Bolton
4,804,064 A * 2/1989 Coultrup ..... B25H 1/06 182/155
D318,785 S 8/1991 Dean
5,497,593 A 3/1996 Riesberg
5,660,637 A * 8/1997 Dodge ..... B05B 13/0285 118/500
6,131,359 A 10/2000 Duff
6,155,440 A * 12/2000 Arce ..... A47F 5/0892 211/118
7,305,802 B1 12/2007 Plavidal
2002/0014568 A1* 2/2002 Faucher ..... A61G 7/1042 248/354.3
2003/0182890 A1 10/2003 Hudson
2006/0150547 A1* 7/2006 Menard ..... E04H 3/02 52/236.3
2008/0087787 A1* 4/2008 Baumer ..... A47B 43/006 248/324
2012/0176012 A1* 7/2012 Koziol, Jr. ..... A47B 95/008 312/237

FOREIGN PATENT DOCUMENTS

CA 2429588 A1 12/2003

* cited by examiner

*Primary Examiner* — Brian E Glessner
*Assistant Examiner* — Daniel J Kenny

(57) ABSTRACT

The sub-floor brace for abating squeaking floors is a structural element that is configured for use with a supported flooring. The sub-floor brace for abating squeaking floors supports the supported flooring from the ceiling side of the supported flooring. The sub-floor brace for abating squeaking floors supplements the load carrying capacity of the joists that are supporting the supported flooring by creating a load path from the supported flooring to a supporting flooring located in an inferior location to the supported flooring. The supplemental load paths created by the sub-floor brace for abating squeaking floors reduce the squeaking noise commonly associated with aging floors. The sub-floor brace for abating squeaking floors is a telescopic structure that comprises a first support, a second support, and a fastener. The fastener attaches the first support to the second support.

10 Claims, 5 Drawing Sheets

SUB-FLOOR BRACE FOR ABATING SQUEAKING FLOORS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of building including structural elements, more specifically, a load supporting brace configured for use with joists.

Summary of Invention

The sub-floor brace for abating squeaking floors is a structural element that is configured for use with a supported flooring. The sub-floor brace for abating squeaking floors supports the supported flooring from the ceiling side of the supported flooring. The sub-floor brace for abating squeaking floors supplements the load carrying capacity of the joists that are supporting the supported flooring by creating a load path from the supported flooring to a supporting flooring located in an inferior location to the supported flooring. The supplemental load paths created by the sub-floor brace for abating squeaking floors reduce the squeaking noise commonly associated with aging floors. The sub-floor brace for abating squeaking floors is a telescopic structure that comprises a first support, a second support, and a fastener. The fastener attaches the first support to the second support.

These together with additional objects, features and advantages of the sub-floor brace for abating squeaking floors will be readily apparent to those of ordinary skill in the art upon reading the following detailed description of the presently preferred, but nonetheless illustrative, embodiments when taken in conjunction with the accompanying drawings.

In this respect, before explaining the current embodiments of the sub-floor brace for abating squeaking floors in detail, it is to be understood that the sub-floor brace for abating squeaking floors is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sub-floor brace for abating squeaking floors.

It is therefore important that the claims be regarded as including such equivalent construction insofar as they do not depart from the spirit and scope of the sub-floor brace for abating squeaking floors. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
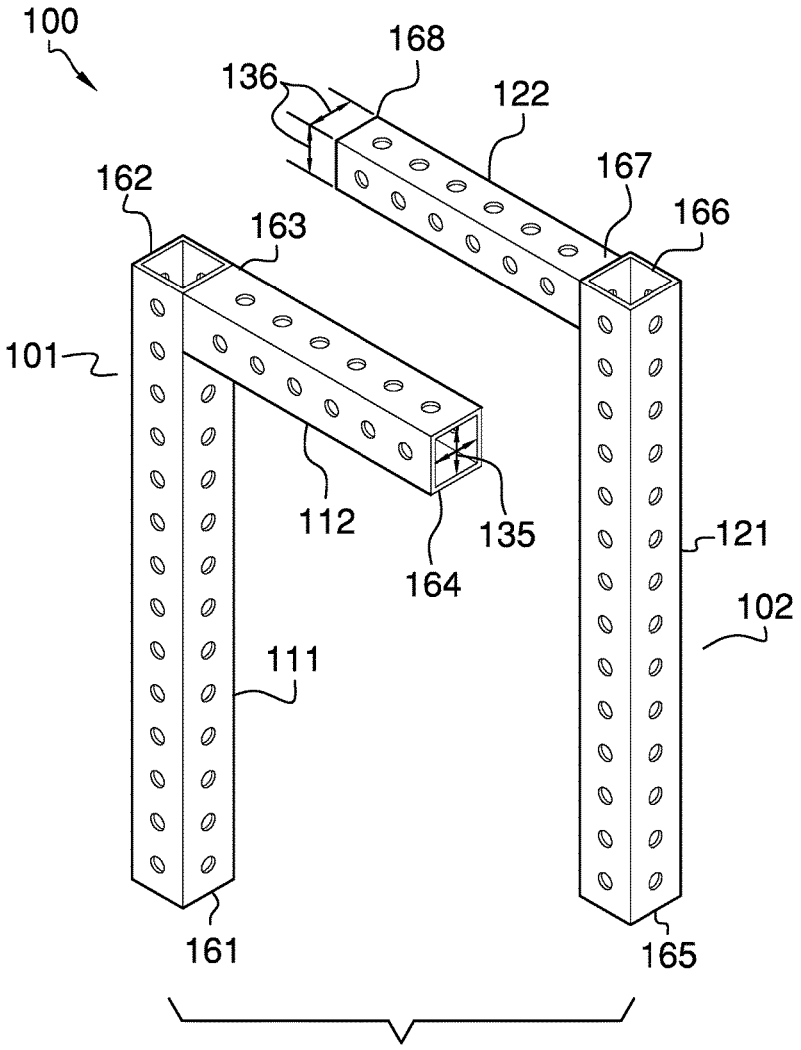
FIG. 1 is a perspective view of an embodiment of the disclosure.
Figure 2:
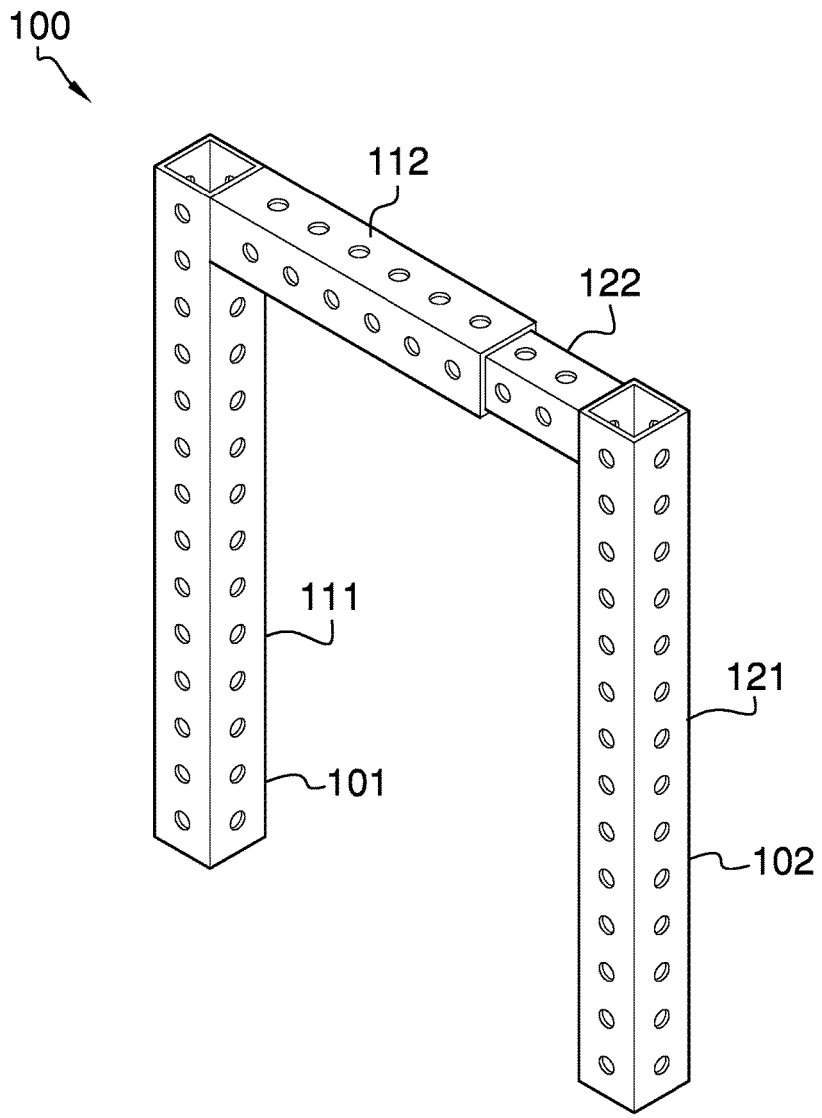
FIG. 2 is a perspective view of an embodiment of the disclosure.
Figure 3:
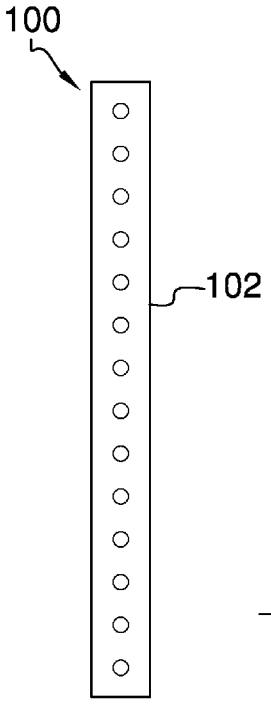
FIG. 3 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The sub-floor brace for abating squeaking floors 100 (hereinafter invention) is a structural element that is configured for use with a supported flooring 142. The supported flooring 142 refers to the flooring that will be supported by the invention 100. The supported flooring 142 is further defined with a floor side 151 and a ceiling side 152. The floor side 151 refers to the superior surface of the supported flooring 142. The ceiling side 152 refers to the inferior surface of the supported flooring 142. The invention 100 supports the supported flooring 142 from the ceiling side 152 of the supported flooring 142.

The invention 100 supplements the load carrying capacity of the joists 141 that are supporting the supported flooring 142 by creating a load path from the supported flooring 142 to a second supporting flooring 143 located in an inferior location to the supported flooring 142. The joists 141 refer to a plurality of beams that are used to support the supported flooring 142. The second supporting flooring 143 refers to a flooring or horizontal surface: 1) upon which the invention 100 is placed; and, 2) that receives the load from the supported flooring 142 that is being distributed through the invention 100.

The supplemental load paths created by the invention 100 reduce the squeaking noise commonly associated with aging floors. The invention 100 is a telescopic structure that comprises a first support 101, a second support 102, and a fastener 103. The fastener 103 attaches the first support 101 to the second support 102.

The first support 101 is an L shaped structure that forms a leg of the invention 100. The first support 101 comprises a first stanchion 111 and a first cantilever 112. The first stanchion 111 is further defined with a first end 161, a second end 162, and a first center axis 131. The first cantilever 112 is further defined with a third end 163, a fourth end 164, a second center axis 132, and an inner dimension 135.

The first center axis 131 is the center axis of the first stanchion 111, which runs from the center of the first end 161 to the center of the second end 162. The second center axis 132 is the center axis of the first cantilever 112, which runs from the center of the third end 163 to the center of the fourth end 164. The inner dimension 135 refers to the inner dimension 135 associated with the first cantilever 112.

The first end 161 is the end of the first stanchion 111 that is proximal to the second supporting flooring 143 when the invention 100 is in use. The second end 162 is the end of the first stanchion 111 that is proximal to the supported flooring 142 when the invention 100 is in use. The third end 163 is the end of the first cantilever 112 that is proximal to the first stanchion 111. The third end 163 is the fixed end of the cantilever formed by the first cantilever 112. The fourth end 164 is the free end of the first cantilever 112.

The first stanchion 111 is a hollow square metal tube. In the first potential embodiment of the disclosure, the first stanchion 111 is a readily available square metal perforated tube. The first stanchion 111 provides a load path from the supported flooring 142 to the second supporting flooring 143.

The first cantilever 112 is a cross brace that supports the supported flooring 142 from the ceiling side 152 of the supported flooring 142. The first cantilever 112 is a hollow square metal tube. In the first potential embodiment of the disclosure, the first cantilever 112 is a readily available square metal perforated tube. The first cantilever 112 is formed from the same tube stock as the first stanchion 111.

The second support 102 is an L shaped structure that forms a leg of the invention 100. The second support 102 comprises a second stanchion 121 and a second cantilever 122. The second stanchion 121 is further defined with a fifth end 165, a sixth end 166, and a third center axis 133. The second cantilever 122 is further defined with a seventh end 167, an eighth end 168, a fourth center axis 134, and an outer dimension 136.

The third center axis 133 is the center axis of the second stanchion 121, which runs from the center of the fifth end 165 to the center of the sixth end 166. The fourth center axis 134 is the center axis of the second cantilever 122, which runs from the center of the seventh end 167 to the center of the eighth end 168. The outer dimension 136 refers to the outer dimension 136 associated with the second cantilever 122.

The fifth end 165 is the end of the second stanchion 121 that is proximal to the second supporting flooring 143 when the invention 100 is in use. The sixth end 166 is the end of the second stanchion 121 that is proximal to the supported flooring 142 when the invention 100 is in use. The seventh end 167 is the end of the second cantilever 122 that is proximal to the second stanchion 121. The seventh end 167 is the fixed end of the cantilever formed by the second cantilever 122. The eighth end 168 is the free end of the second cantilever 122.

The second stanchion 121 is a hollow square metal tube. In the first potential embodiment of the disclosure, the second stanchion 121 is a readily available square metal perforated tube. The dimensions of the second stanchion 121 are identical to the dimensions of the first stanchion 111. The second stanchion 121 provides a load path from the supported flooring 142 to the second supporting flooring 143.

The second cantilever 122 is a cross brace that supports the supported flooring 142 from the ceiling side 152 of the supported flooring 142. The second cantilever 122 is a hollow square metal tube. In the first potential embodiment of the disclosure, the second cantilever 122 is a readily available square metal perforated tube. The tube stock of the second cantilever 122 is selected such that the outer dimension 136 of the second cantilever 122 is lesser than the inner dimension 135 of the first cantilever 112 such that the second cantilever 122 can be inserted into the first cantilever 112.

The fastener 103 is a mechanical detent that attaches the first support 101 and the second support 102. In the first potential embodiment of the disclosure, the fastener 103 comprises a bolt, screw, nail, rivet, or other commonly used fastener. The fastener 103 is a readily and commercially available shaft that is sized to be inserted into: 1) a first perforation formed in the first cantilever 112; and optionally, as well as, 2) a second perforation formed in the second cantilever 122. Also, the fastener 103 may be used to secure the invention 100 to the joists 141.

Figure 4:
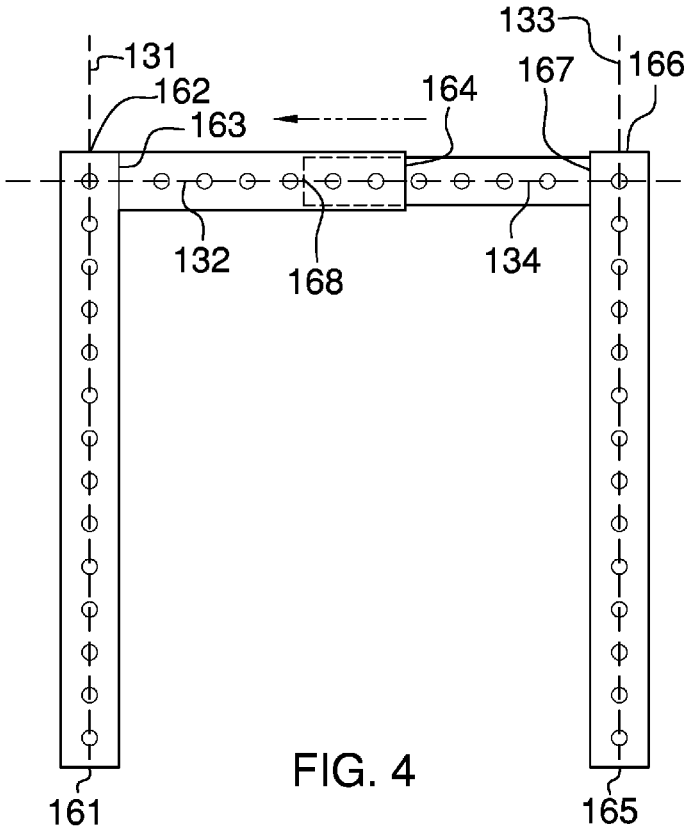
FIG. 4 is a front view of an embodiment of the disclosure.
Figure 5:
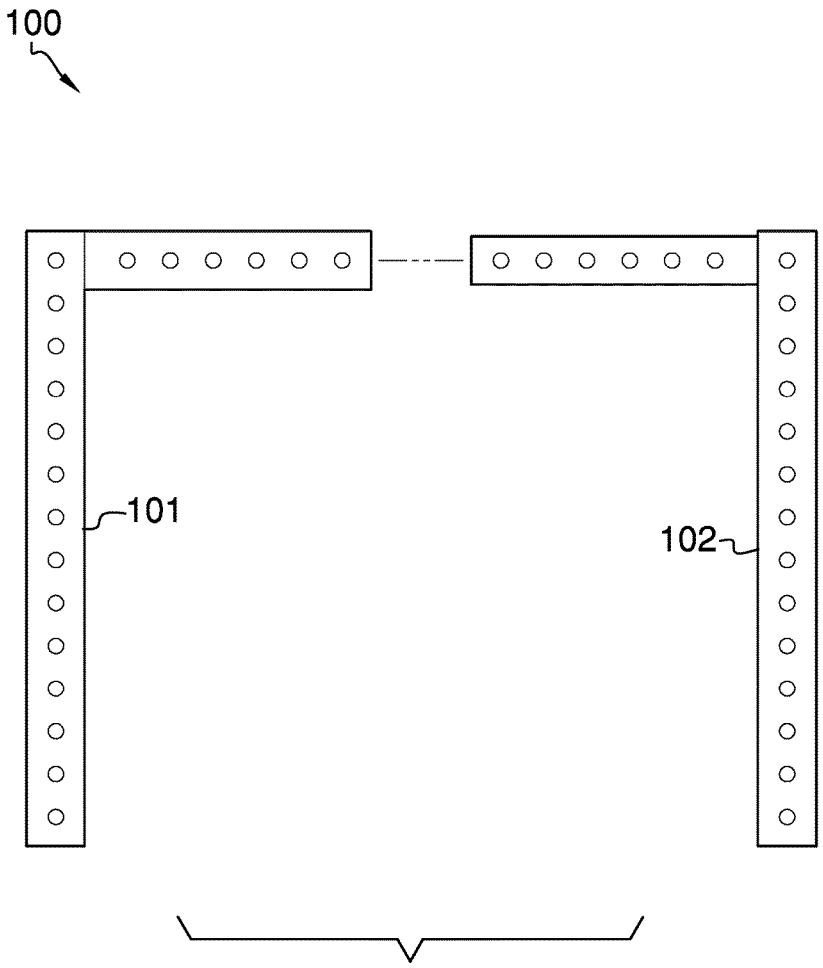
FIG. 5 is an exploded view of an embodiment of the disclosure.
Figure 6:
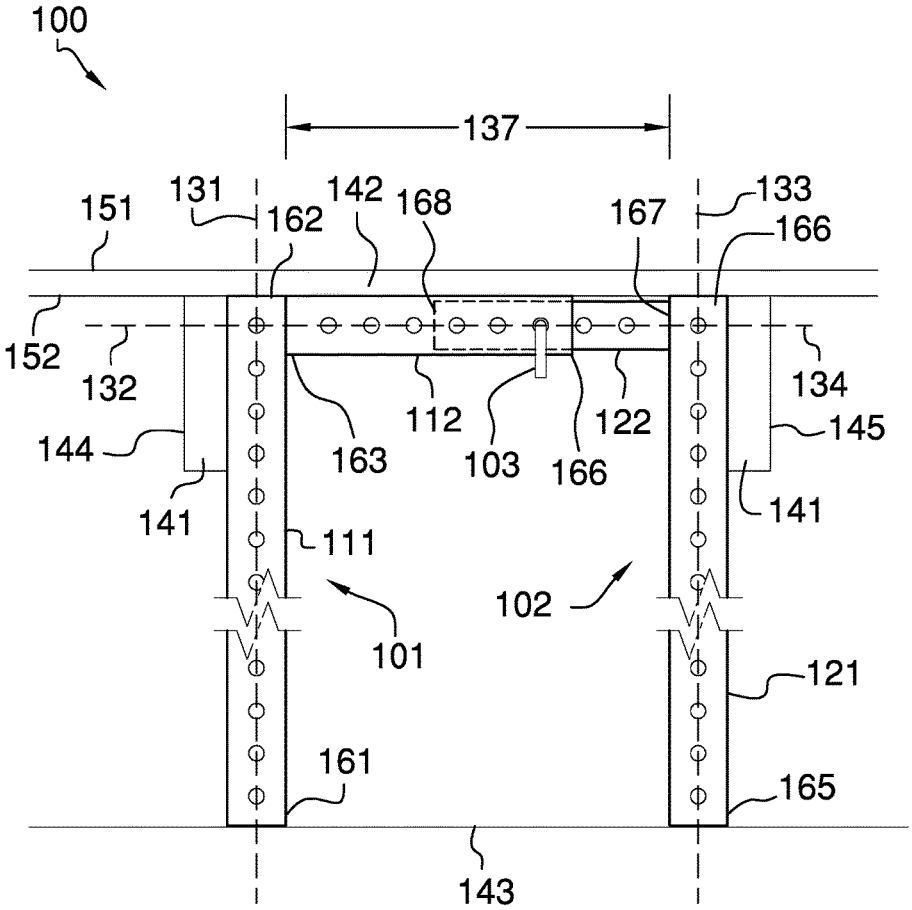
FIG. 6 is an in use view of an embodiment of the disclosure.

As shown most clearly in FIGS. 4 and 6, the third end 163 of the first cantilever 112 attaches to the second end 162 of the first stanchion 111 such that: 1) the second center axis 132 intersects perpendicularly with the first center axis 131; and, 2) the face of the first cantilever 112 is flush with the second end 162 of the first stanchion 111.

The seventh end 167 of the second cantilever 122 attaches to the sixth end 166 of the second stanchion 121 such that: 1) the fourth center axis 134 intersects perpendicularly with the third center axis 133; and, 2) the span of the distance between the fourth center axis 134 and the fifth end 165 of the second stanchion 121 is sized such that the fourth center axis 134 and the second center axis 132 are aligned when the first end 161 of the first stanchion 111 and the fifth end 165 of the second stanchion 121 are placed upon the second supporting flooring 143. This alignment will allow the eighth end 168 of the second cantilever 122 to be inserted into the fourth end 164 of the first cantilever 112 when the invention 100 is in use.

The invention 100 is further defined with a support span 137. The support span 137 is further defined as the span of the distance between the third end 163 of the first cantilever 112 and the seventh end 167 of the second cantilever 122 when the invention 100 is in use.

The invention 100 is positioned between the first joist 144 and the second joist 145. The first joist 144 refers to an individual joist that is selected from the joists 141. The second joist 145 refers to an individual joist that is selected from the joists 141. The second joist 145 is selected such that the second joist 145 is adjacent to the first joist 144.

The telescopic structure of the invention 100 comprises the first cantilever 112, the second cantilever 122 and the fastener 103. The fastener 103 connects the first cantilever 112 to the second cantilever 122. The inner dimension 135 of the first cantilever 112 is less than the outer dimension 136 of the second cantilever 122 such that the second cantilever 122 can be inserted into the first cantilever 112 in a telescopic manner. This telescopic arrangement of the invention 100 allows the support span 137 of the invention 100 to be adjusted by adjusting the relative position of the second cantilever 122 within the first cantilever 112. The position of the second cantilever 122 relative to the first cantilever 112 is held in position using the fastener 103.

To use the invention 100, the eighth end 168 of the second cantilever 122 is inserted into the fourth end 164 of the second stanchion 121. As shown most clearly in FIG. 6, the support span 137 is adjusted telescopically such that the first cantilever 112, the second cantilever 122, the second end 162 of the first stanchion 111, and the sixth end 166 of the second stanchion 121 will fit between the first joist 144 and the second joist 145. The second cantilever 122 is locked into position relative to the first cantilever 112 using the fastener 103.

The following definitions were used in this disclosure:

Brace: As used in this disclosure, a brace is a structural element that is used to support or otherwise steady an object.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Ceiling: As used in this disclosure a ceiling refers to either: 1) the superior horizontal surface of a room that is distal from the floor; 2) the superior horizontal surface of a structure; or, 3) the upper limit of a range. A floor and a ceiling can be used to the same structure where the selection depends solely on the point of view of the user. The selection of this definition depends on the context. In situations where the context is unclear the first definition should be used.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or tube like structure. When the center axes of two cylinder or tube like structures share the same line they are said to be aligned. When the center axes of two-cylinder like structures do not share the same line they are said to be offset.

Detent: As used in this disclosure, a detent is a device for attaching a first object to a second object in a detachable manner such that: 1) the relative position of the first object relative to the second object is adjustable; and, 2) the first object is attached to the second object in a detachable manner.

Fastener: As used in this disclosure, a fastener is a device that is used to join or affix two objects. Fasteners generally comprise a first element, which is attached to the first object; and a second element, which is attached to the second object such that the first element and the second element join to affix the first object and the second object.

Floor: As used in this disclosure a floor refers to either: 1) the inferior horizontal surface of a room upon which one stands; 2) the inferior horizontal surface of a structure; 3) a bottom or base; or, 4) the lower limit of a range. The selection of the definition depends on the context. In situations where the context is unclear the third definition should be used.

Flooring: As used in this disclosure, the term flooring refers to the physical structure that forms the physical horizontal surface of a floor.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity.

Inner Dimension: As used in this disclosure, the term inner dimension describes the span from a first inside or interior surface of a container to a second inside or interior surface of a container. The term is used in much the same way that a plumber would refer to the inner diameter of a pipe.

Joists: As used in this disclosure, the term joists refers to a plurality of parallel horizontal beams that are used to support a floor or a ceiling. A single beam selected from the plurality of parallel horizontal beams is referred to in the singular as a joist.

Load Path: As used in this disclosure, a load path refers to a chain of one or more structures that transfers a load generated by a raised structure or object to a foundation or the earth.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Stanchion: As used in this disclosure, a stanchion refers to a vertical pole, post, or support.

Superior: As used in this disclosure, the term superior refers to a directional reference that is parallel to and in the opposite direction of the force of gravity.

Telescopic: As used in this disclosure, telescopic is an adjective that describes an object made of sections that fit or slide into each other such that the object can be made longer or shorter by adjusting the relative positions of the sections.

Tube: As used in this disclosure, a tube is a hollow rectangular device that is used for transporting liquids and gases. The line that connects the center of the first base of the rectangular to the center of the second base of the rectangular is referred to as the center axis of the tube or the centerline of the tube. In this disclosure, the terms inner dimension of a tube and outer dimension of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A structural element comprising:

a first support, a second support, and a fastener;

wherein the fastener attaches the first support to the second support;

wherein the structural element is configured for use with a supported flooring;

wherein the supported flooring is further defined with joists and a flooring;

wherein the supported flooring is further defined with a floor side and a ceiling side;

wherein the structural element is configured to support the supported flooring from the ceiling side of the supported flooring;

wherein the supported flooring refers to a horizontal surface upon which the structural element is placed in use;

wherein in use the horizontal surface receives the load from the supported flooring that is being distributed through the structural element;

wherein the structural element is a telescopic structure;

wherein the first support comprises a first stanchion and a first cantilever;

wherein the first cantilever attaches to the first stanchion;

wherein the first stanchion is further defined with a first end, a second end, and a first center axis;

wherein the first cantilever is further defined with a third end, a fourth end, a second center axis, and an inner dimension;

wherein the first stanchion is a hollow square metal perforated tube;

wherein the first cantilever is a hollow square metal perforated tube;

wherein the first cantilever is formed from the same tube stock as the first stanchion;

wherein the second support comprises a second stanchion and a second cantilever;

wherein the second cantilever attaches to the first cantilever;

wherein the second stanchion is further defined with a fifth end, a sixth end, and a third center axis;

wherein the second cantilever is further defined with a seventh end, an eighth end, a fourth center axis, and an outer dimension;

wherein the second stanchion is a hollow square metal perforated tube;

wherein the dimensions of the second stanchion are identical to the dimensions of the first stanchion;

wherein the second cantilever is a hollow square metal perforated tube;

wherein the tube stock of the second cantilever is selected such that the outer dimension of the second cantilever is lesser than the inner dimension of the first cantilever such that the second cantilever can be inserted into the first cantilever;

wherein the fastener is a mechanical detent;

wherein the third end of the first cantilever attaches to the second end of the first stanchion such that the second center axis intersects perpendicularly with the first center axis;

wherein the third end of the first cantilever attaches to the second end of the first stanchion such that the face of the first cantilever is flush with the second end of the first stanchion;

wherein the seventh end of the second cantilever attaches to the sixth end of the second stanchion such that the fourth center axis intersects perpendicularly with the third center axis;

wherein the seventh end of the second cantilever attaches to the sixth end of the second stanchion such that the span of the distance between the fourth center axis and the fifth end of the second stanchion is sized such that the fourth center axis and the second center axis are aligned when the first end of the first stanchion and the fifth end of the second stanchion are placed upon the supporting flooring;

wherein this alignment will allow the eighth end of the second cantilever to be inserted into the fourth end of the first cantilever when the structural element is in use.

2. The structural element according to claim 1 wherein the structural element comprises a support span;

wherein the support span is adjustable;

wherein the support span is further defined as the span of the distance between the third end of the first cantilever and the seventh end of the second cantilever when the structural element is in use.

3. The structural element according to claim 2 wherein the telescopic structure of the structural element comprises the first cantilever, the second cantilever, and the fastener;

wherein the fastener connects the first cantilever to the second cantilever.

4. The structural element according to claim 3 wherein the eighth end of the second cantilever is inserted into the fourth end of the first cantilever;

wherein the support span of the structural element is adjusted by adjusting the relative position of the second cantilever within the first cantilever;

wherein the position of the second cantilever relative to the first cantilever is held in position using the fastener.

5. The structural element according to claim 4 wherein in use the structural element is positioned between the first joist and the second joist;

wherein the first joist refers to an individual joist that is selected from the joists;

wherein the second joist refers to an individual joist that is selected from the joists;

wherein the second joist is selected such that the second joist is adjacent to the first joist.

6. The structural element according to claim 5 wherein the support span is configured to adjust telescopically such that the first cantilever, the second cantilever, the second end of the first stanchion, and the sixth end of the second stanchion in use will fit between the first joist and the second joist.

7. The structural element according to claim 6 wherein the first end of the first stanchion is configured to be placed on the supporting flooring;

wherein the fifth end of the second stanchion is configured to be placed on the supporting flooring.

8. The structural element according to claim 7 wherein the first cantilever is a cross brace that is configured to be placed against the supported flooring from the ceiling side of the supported flooring;

wherein the second cantilever is a cross brace that is configured to be placed against the supported flooring from the ceiling side of the supported flooring;

wherein the first stanchion is configured to provide a load path from the supported flooring to the supporting flooring;

wherein the second stanchion is configured to provide a load path from the supported flooring to the supporting flooring.

9. The structural element according to claim 8 wherein the fastener is sized to be inserted into a first perforation selected from the first cantilever;

wherein the fastener is sized to be inserted into a second perforation selected from the second cantilever.

10. The structural element according to claim 9 wherein the fastener secures the first cantilever to the second cantilever by simultaneously inserting the fastener through the first selected perforation of the first cantilever and the second selected perforation of the second cantilever.

* * * * *